US008377371B2

(12) United States Patent
Govindaswami

(10) Patent No.: US 8,377,371 B2
(45) Date of Patent: Feb. 19, 2013

(54) SYSTEM AND METHOD FOR PRODUCING METALLIC IRON

(75) Inventor: Narayan Govindaswami, Charlotte, NC (US)

(73) Assignee: Nu-Iron Technology, LLC, Charlotte, NC (US)

( * ) Notice: Subject to any disclaimer, the term of this patent is extended or adjusted under 35 U.S.C. 154(b) by 0 days.

(21) Appl. No.: 13/245,653

(22) Filed: Sep. 26, 2011

(65) Prior Publication Data

US 2012/0013054 A1 Jan. 19, 2012

Related U.S. Application Data

(62) Division of application No. 12/337,998, filed on Dec. 18, 2008, now Pat. No. 8,025,711.

(60) Provisional application No. 61/015,013, filed on Dec. 19, 2007.

(51) Int. Cl.
*C21B 13/10* (2006.01)

(52) U.S. Cl. ..... 266/81; 266/152; 266/195; 432/128; 432/137

(58) Field of Classification Search ..... 266/142, 266/195, 81; 432/128, 137
See application file for complete search history.

(56) References Cited

U.S. PATENT DOCUMENTS

| | | | | |
|---|---|---|---|---|
| 2,372,657 | A | 4/1945 | Boynton | |
| 2,416,908 | A | 3/1947 | Cornelius | |
| 3,623,714 | A * | 11/1971 | Firmin | 432/11 |
| 3,713,631 | A * | 1/1973 | Enk et al. | 432/243 |
| 4,745,252 | A | 5/1988 | Roth et al. | |
| 6,630,010 | B2 | 10/2003 | Ito et al. | |
| 7,628,839 | B2 | 12/2009 | Iwaski et al. | |
| 8,133,299 | B2 * | 3/2012 | Brandon et al. | 75/484 |
| 2004/0163493 | A1 | 8/2004 | Harada et al. | |
| 2004/0173054 | A1 | 9/2004 | Tsuge et al. | |
| 2005/0229748 | A1 | 10/2005 | Bleifuss et al. | |

FOREIGN PATENT DOCUMENTS

| | | |
|---|---|---|
| BE | 1011116 | 5/1999 |
| EP | 0170585 | 2/1985 |

OTHER PUBLICATIONS

International Search Report and Written Opinion in PCT/US2008/087353, dated Aug. 4, 2009.

* cited by examiner

*Primary Examiner* — George Wyszomierski
*Assistant Examiner* — Tima M McGuthry Banks
(74) *Attorney, Agent, or Firm* — Hahn Loeser & Parks LLP

(57) ABSTRACT

A battery of stationary hearth furnaces, and method for using, for producing metallic iron nodules having a furnace having a stationary hearth, an inlet and an outlet; a heating chamber beneath the stationary hearth having heated fluids circulated thereto and heating reducible material on the stationary hearth; passageways circulating fluids, through ports from the furnace housing above the reducible material to the heating chamber beneath; burners and air inlets in the furnace and optionally in at least one passageway and a heating chamber for drying and heating the reducible material, driving off and burning volatile material, and forming metallic iron nodules; a loading device for loading reducible material and optionally hearth material onto the stationary hearth through the inlet; and a discharging device capable of discharging metallic iron nodules and optionally related material from the stationary hearth through the outlet.

9 Claims, 10 Drawing Sheets

SYSTEM AND METHOD FOR PRODUCING METALLIC IRON

This invention claims priority to and the benefit of U.S. patent application Ser. No. 12/337,998, filed Dec. 18, 2008, now U.S. Pat. No. 8,025,711 issued on Sep. 27, 2011, which claims priority to and the benefit of U.S. Provisional Patent Application No. 61/015,013, filed Dec. 19, 2007, both of which are incorporated herein by reference.

BACKGROUND AND SUMMARY

Metallic iron has been produced by reducing iron oxide such as iron ores, iron pellets and other iron sources. Various such methods have been proposed so far for directly producing metallic iron from iron ores or iron oxide pellets by using reducing agents such as coal or other carbonaceous material.

These processes have been carried out in rotary hearth and linear hearth furnaces. An example of such a rotary hearth furnace is described in U.S. Pat. No. 3,443,931. An example of such a linear hearth furnace is described in US 2005/229748. Both the rotary hearth furnace and the linear hearth furnace involve making mixtures of carbonaceous material with iron ore or other iron oxide fines into balls, briquettes or other compacts, and heating them on a moving hearth furnace to reduce the iron oxide to metallic iron nuggets and slag.

A limitation of these furnaces, and the methods of operating these furnaces, in the past has been their energy efficiency. The iron oxide bearing material and associated carbonaceous material generally had to be heated in the furnace to about 1370° C. (about 2500° F.), or higher, to reduce the iron oxide and produce metallic iron material. The furnace generally required natural gas or coal to be burned to produce the heat necessary to heat the iron oxide bearing material and associated carbonaceous material to the high temperatures to reduce the iron oxide and produce a metallic iron material. Furthermore, the reduction process involved production of volatiles in the furnace that had to be removed from the furnace and secondarily combusted to avoid an environmental hazard, which added to the energy needs to perform the iron reduction. See, e.g., U.S. Pat. No. 6,390,810. What has been needed is a furnace that reduces the energy consumption needed to reduce the iron oxide bearing material such that a large part, if not all, of the energy to heat the iron oxide bearing material to the temperature necessary to cause the iron oxide to be reduced to metallic iron and slag comes from burning volatiles directly in the furnace itself and otherwise using heat generated in one part of the furnace in another part of the furnace.

A method of producing metallic iron nodules in a battery of stationary hearth furnaces is disclosed comprising the steps of:

(a) assembling a furnace housing having a stationary hearth, an inlet capable of delivering reducible material to the stationary hearth from a first side, and an outlet capable of discharging reduced iron nodules from the stationary hearth from a second side opposite the first side;

(b) assembling a heating chamber beneath the stationary hearth capable of having heated fluids circulated thereto and heating the reducible material on the stationary hearth;

(c) assembling passageways capable of circulating fluids given off by heating the reducible material positioned on the stationary hearth through ports from the furnace housing above the reducible material to the heating chamber beneath the stationary hearth;

(d) assembling burners and fluid inlet ports in the furnace housing and optionally in at least one of the passageways and heating chamber to heat the reducible material on the stationary hearth;

(e) loading reducible material and optionally an underlying hearth material onto the stationary hearth through the inlet in the first side of the furnace housing;

(f) varying the temperature within the furnace housing to dry and heat the reducible material, drive off and burn volatile material from the reducible material, and reduce at least a major portion of the reducible material to form metallic iron nodules; and (g) discharging the metallic iron nodules and optionally related material from the stationary hearth furnace through the outlet in the second side of the furnace housing.

The loading step may be performed by a conveying device capable of positioning the reducible material and optionally the hearth material onto the stationary hearth, and the conveying device may be capable of loading the reducible material onto the stationary hearth in a substantially singular layer. Alternately, the loading step may be performed by providing on a movable device the reducible material and optionally the hearth material, and then positioning the loaded movable device onto the stationary hearth, where the movable device may then be removed from the furnace housing leaving the reducible material, and if present the underlying hearth material, on the stationary hearth before starting step (f). In yet another alternate, the movable device may remain in the furnace housing during step (f), and the movable device being removed from the furnace housing during step (g).

The discharging step may be performed by a pushing device capable of pushing at least a majority of the reduced metallic nodules through the outlet in the second side from the stationary hearth.

The method of producing metallic iron nodules in a battery of stationary hearth furnaces may further include the step of delivering at least a portion of the volatile material from the reducible material to adjacent the burners to be capable of being burned. In addition, the heating chamber may be assembled with baffles to increase the residence time of heated fluids in the heating chamber and heat the reducible material on the stationary hearth in the furnace housing.

The method may further include steps of assembling a flue adjacent the heating chamber capable of heating fluids passing therethrough, and transferring fluids heated in the flue into the furnace housing.

Also disclosed is a battery of stationary hearth furnaces operable to produce metallic iron nodules comprising:

a plurality of stationary hearth furnaces, each stationary hearth furnace including:

a furnace housing having a stationary hearth, an inlet on a first side operable to deliver reducible material to the stationary hearth, and an outlet on a second side opposite the first side operable to discharge reduced iron nodules from the stationary hearth;

a heating chamber beneath the stationary hearth operable to circulate heated fluids heating reducible material on the stationary hearth;

passageways between ports in the furnace housing and the heating chamber operable to circulate fluids given off by heating reducible material on the stationary hearth through the ports from the furnace housing above the reducible material to the heating chamber beneath the stationary hearth;

burners and air inlet ports in the furnace housing above the stationary hearth and optionally in the passageways and heating chamber capable of drying and heating the reducible material, driving off and burning volatile material from the reducible material, and reducing at least a major portion of the reducible material to form metallic iron nodules;

a loading device movable from one to stationary hearth furnace in the battery to another operable to load reducible material and optionally an underlying hearth material onto the stationary hearths of the plurality of stationary hearth furnaces through the inlet in the first side of each furnace housing; and a discharging device operable to discharge metallic iron nodules and optionally related material from the stationary hearth through the outlet of the second side of the furnace housing.

The loading device may be capable of positioning the reducible material and optionally the hearth material onto the stationary hearth. The loading device may be capable of loading the reducible material onto the stationary hearth in a substantially singular layer. Alternately, the stationary hearth furnace may comprise a movable device capable of being loaded with the reducible material and optionally the hearth material, and then capable of being positioned on the stationary hearth. The movable device may be capable of being removed from the furnace housing leaving the reducible material and if present the underlying hearth material on the stationary hearth.

The discharging device may be capable of pushing at least a majority of the reduced metallic nodules from the stationary hearth through the outlet in the second side in the furnace housing. The heating chamber may have baffles to increase the residence time of the heated fluids in the heating chamber and heat the reducible material on the stationary hearth in the furnace housing. The hearth furnace may further include a flue adjacent the heating chamber and capable of receiving and heating fluids and transferring heated fluids from the flue into the furnace housing.

DETAILED DESCRIPTION OF THE DRAWINGS

Figure 1:
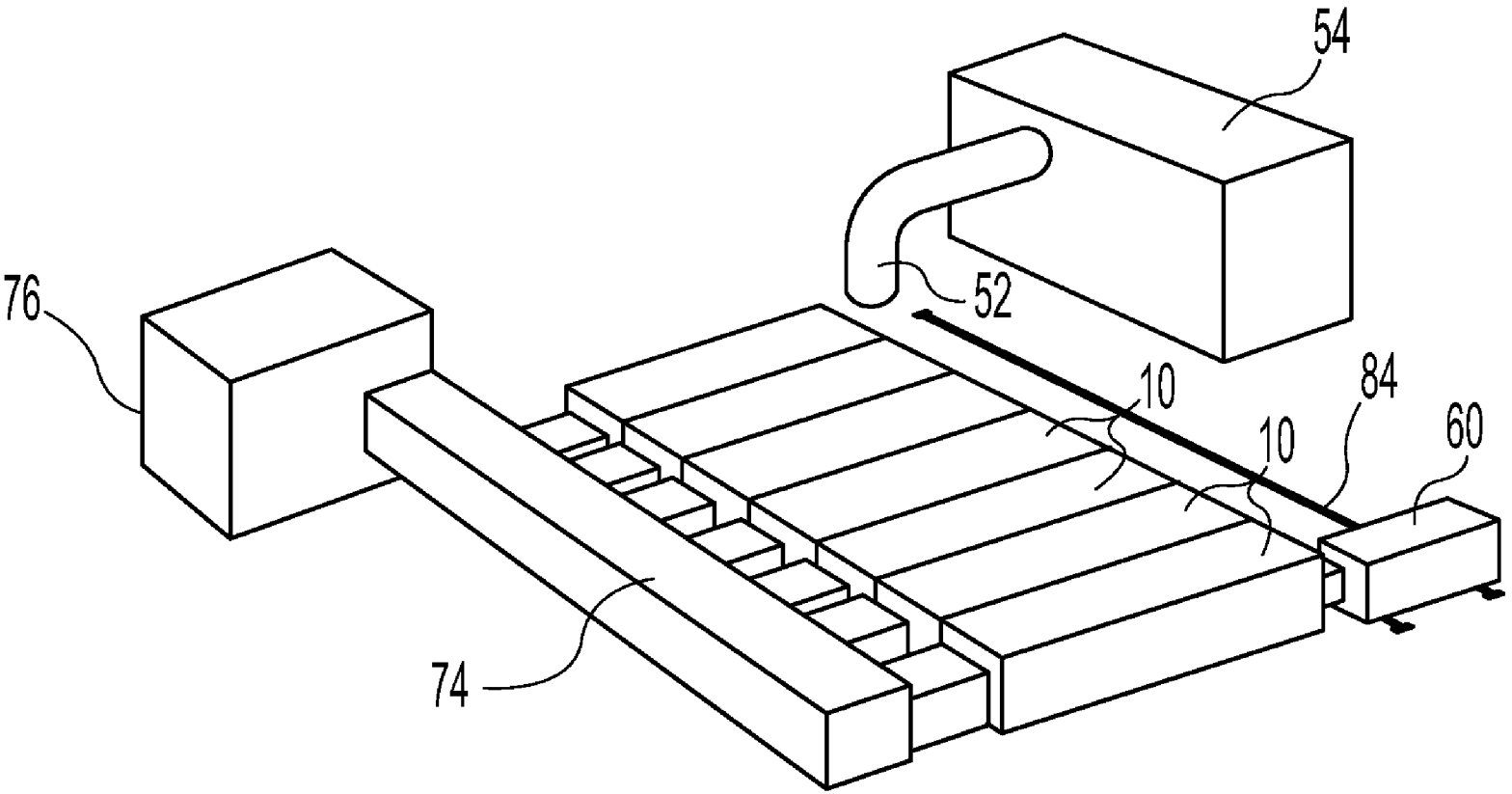
FIG. 1 is an diagrammatical perspective view illustrating a battery of stationary hearth furnaces for producing metallic iron material.
Figure 8:
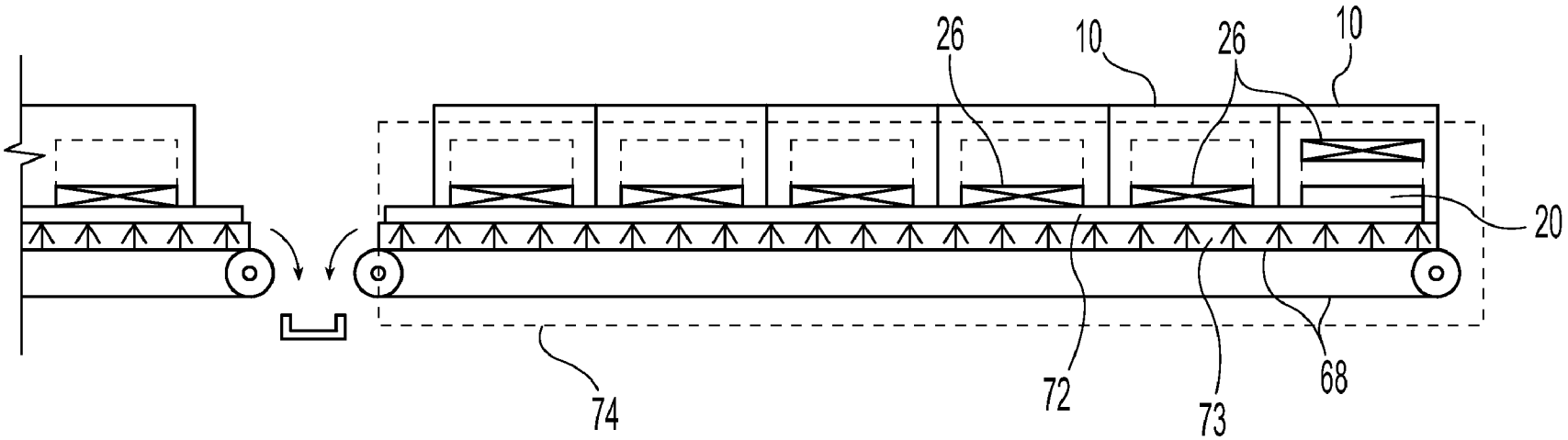
FIG. 8 is a side view of a battery of the stationary hearth furnaces of FIG. 1 illustrating a conveyor and cooling system.

A battery of stationary hearth furnaces 10 is shown in FIG. 1 for producing metallic iron material directly from iron ore and other iron oxide sources. The stationary hearth furnaces 10 may be arranged in a battery, or group, of furnaces for processing larger amounts of metallic iron material. The battery or group of stationary hearth furnaces may include at least two stationary hearth furnaces 10, and may include any number of stationary hearth furnaces, such as seven as shown in FIG. 1, six as shown in FIG. 8, or twenty hearth furnaces, or more. The stationary hearth furnaces 10 may be arranged in one or more rows. Alternately, only one stationary hearth furnace may be used. The number of hearth furnaces 10 needed may be determined by considering the desired total output of the plant or installation compared to the output of one hearth furnace.

The stationary hearth furnaces 10 arranged in a battery or group may share waste gas collection and processing equipment, material conveyors, cooling systems, and other processing equipment as desired, as described below.

Each stationary hearth furnace 10 has a furnace housing 12 having a stationary hearth 14. The furnace housing 12 is internally lined with a refractory material suitable to withstand the temperatures involved in the metallic iron reduction process performed in the furnace. The stationary hearth 14 of the hearth furnace 10 is made of a refractory material and capable of supporting at least one layer of reducible material and optionally an underlying hearth material. The hearth furnace 10 has an inlet 16 capable of delivering the reducible material to the stationary hearth from a first side 18, and an outlet 20 capable of discharging reduced iron nodules from the stationary hearth from a second side 22 opposite the first side 18.

An inlet door 24, which can be raised and closed, covers the inlet 16 when the furnace is in operation, and an outlet door 26, which can be raised and closed, covers the outlet 20 when the furnace is in operation. The inlet door 24 is raised to deliver the reducible material to the stationary hearth from the first side 18 through inlet 16 of the stationary hearth furnace. Both the inlet door 24 and the outlet door 26 may be raised to discharge the metallic iron nodules and related material from the stationary hearth from the second side 22 through the outlet 20 of the stationary hearth furnace.

Figure 3:
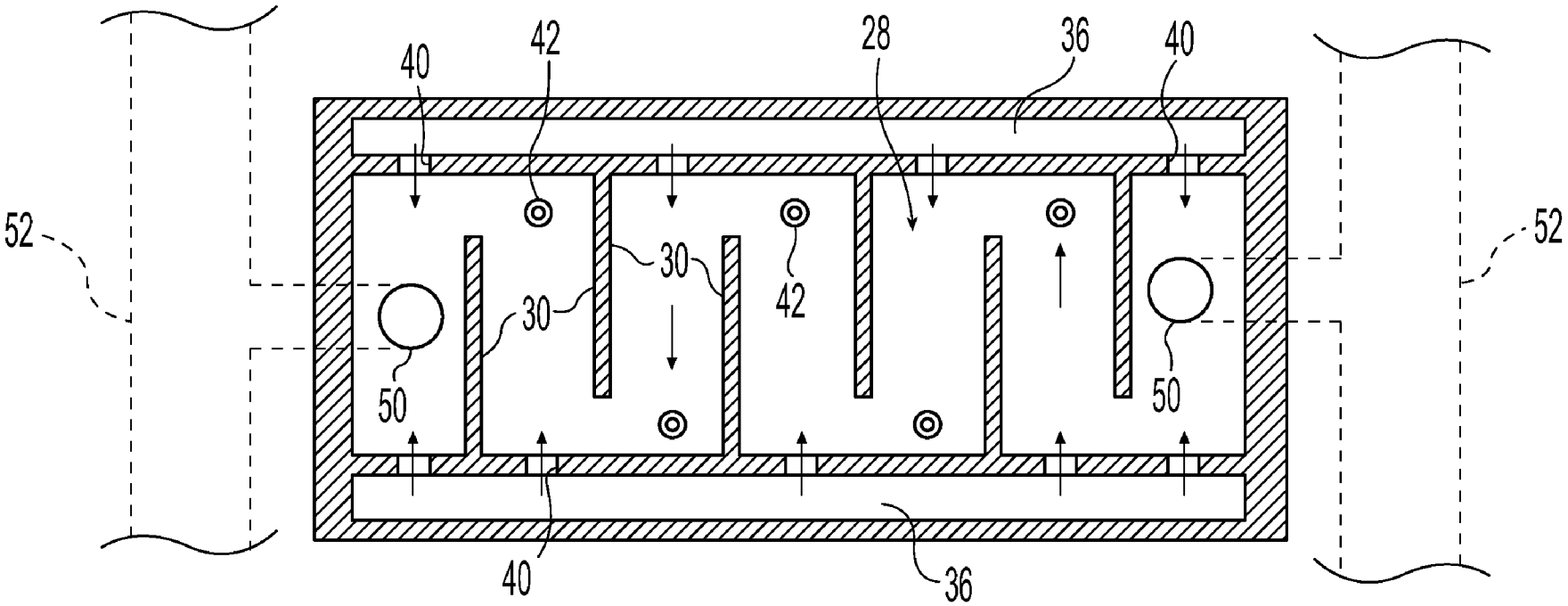
FIG. 3 is a cross-sectional view taken along line 3-3 of FIG. 2.

The stationary hearth furnace 10 has a heating chamber 28 beneath the stationary hearth 14 capable of having heated fluids circulated thereto and heating reducible material on the stationary hearth 14. As shown in FIG. 3, the heating chamber 28 may include baffles 30 for directing a flow of heated fluids through the heating chamber 28. The plurality of baffles 30 are capable of increasing the residence time of the flow of heated fluids through the heating chamber 28 and in turn increasing heat transfer from the heating chamber 28 to the stationary hearth 14 and the reducible material on the stationary hearth. The baffles 30 may be arranged such that the flow of fluid through the heating chamber 28 is in a series of "S" shape patterns.

Passageways 36 are provided and capable of carrying fluids from the furnace housing 12 to the heating chamber 28. Each passageway 36 may be a chamber or chambers laterally positioned in the side(s) of the furnace housing 12 with a double refractory wall, or ducting which extends through the side(s) of the furnace housing 12 as shown in FIGS. 3-6.

The hearth furnace 10 includes burners 42 and fluid ports 44 in the furnace housing 12, and optionally in the passageways 36 and the heating chamber 28, capable of providing a heated atmosphere for drying and heating the reducible material, driving off and burning the volatile material from the reducible material, and reducing at least a portion of the reducible material to form metallic iron nodules. The fluid ports 44 are provided for supplying air and other combustion gases to enable or improve combustion of fuel delivered through the burners 42 and of the volatiles from the reducible material on the stationary hearth. The burners 42 and fluid ports 44 are positioned above the stationary hearth 14 typically to avoid turbulence near the reducible material on the stationary hearth, and may provide for temperature control above the hearth. The burners 42 and fluid ports 44 optionally may also be positioned in the passageways 36 and the heating chamber 28, and used to burn volatile materials that remain in the flow of gases from the furnace housing 12 from above the stationary hearth. As volatiles from the reducible materials are burned providing heat in the furnace to reduce the reducible material, the amount of natural gas, propane, or other combustion fuel required to be delivered through the burners 42 may be reduced, and potentially eliminated when the amount of volatile material is sufficient to maintain the desired processing temperatures. The number of burners 42 and fluid ports 44 and the placement of the burners 42 and fluid ports 44 may be determined by gas flow modeling and/or empirical data for the particular embodiment of the furnace.

Figure 4:
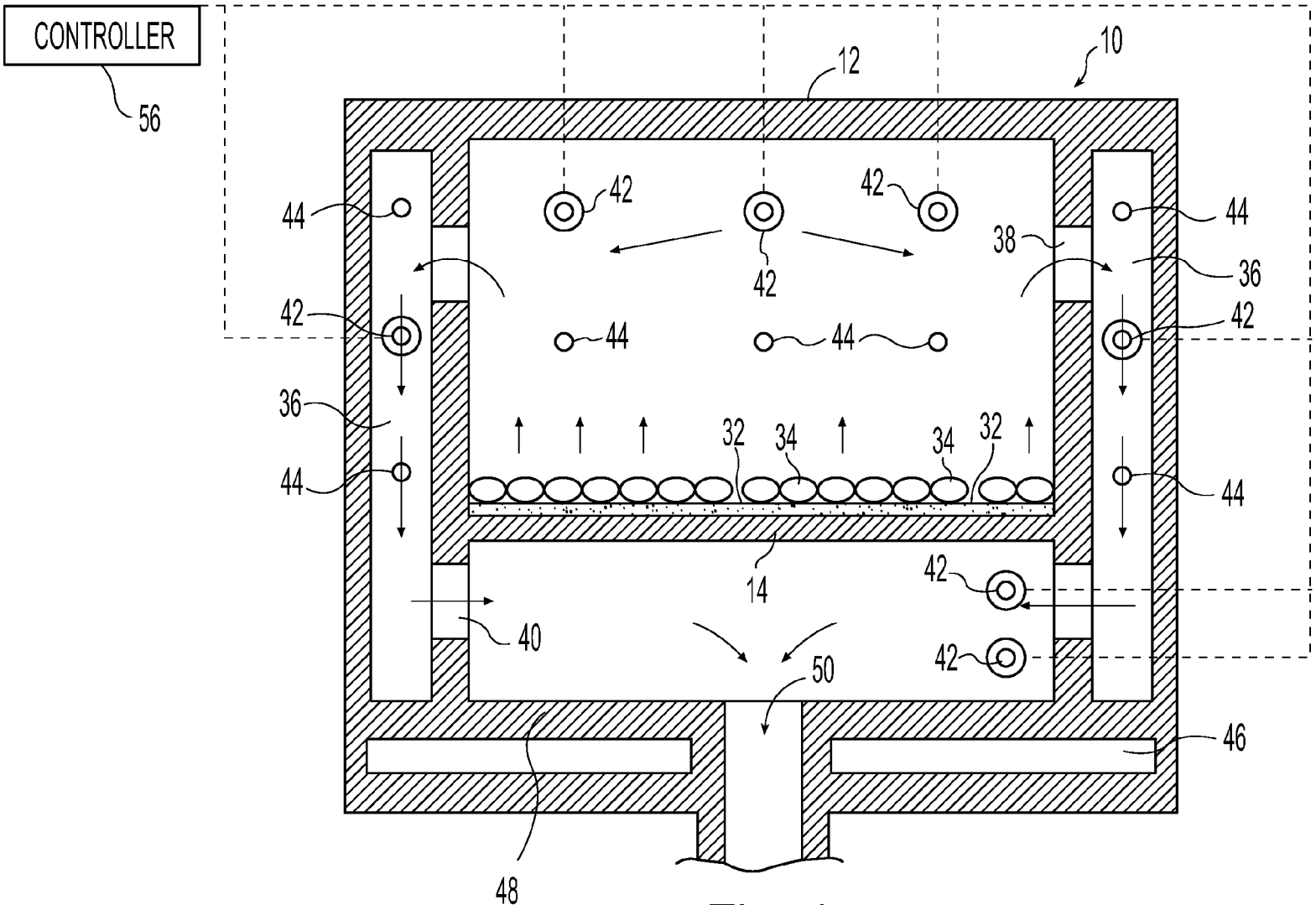
FIG. 4 is a cross-sectional view taken along line 4-4 of FIG. 2.
Figure 5:
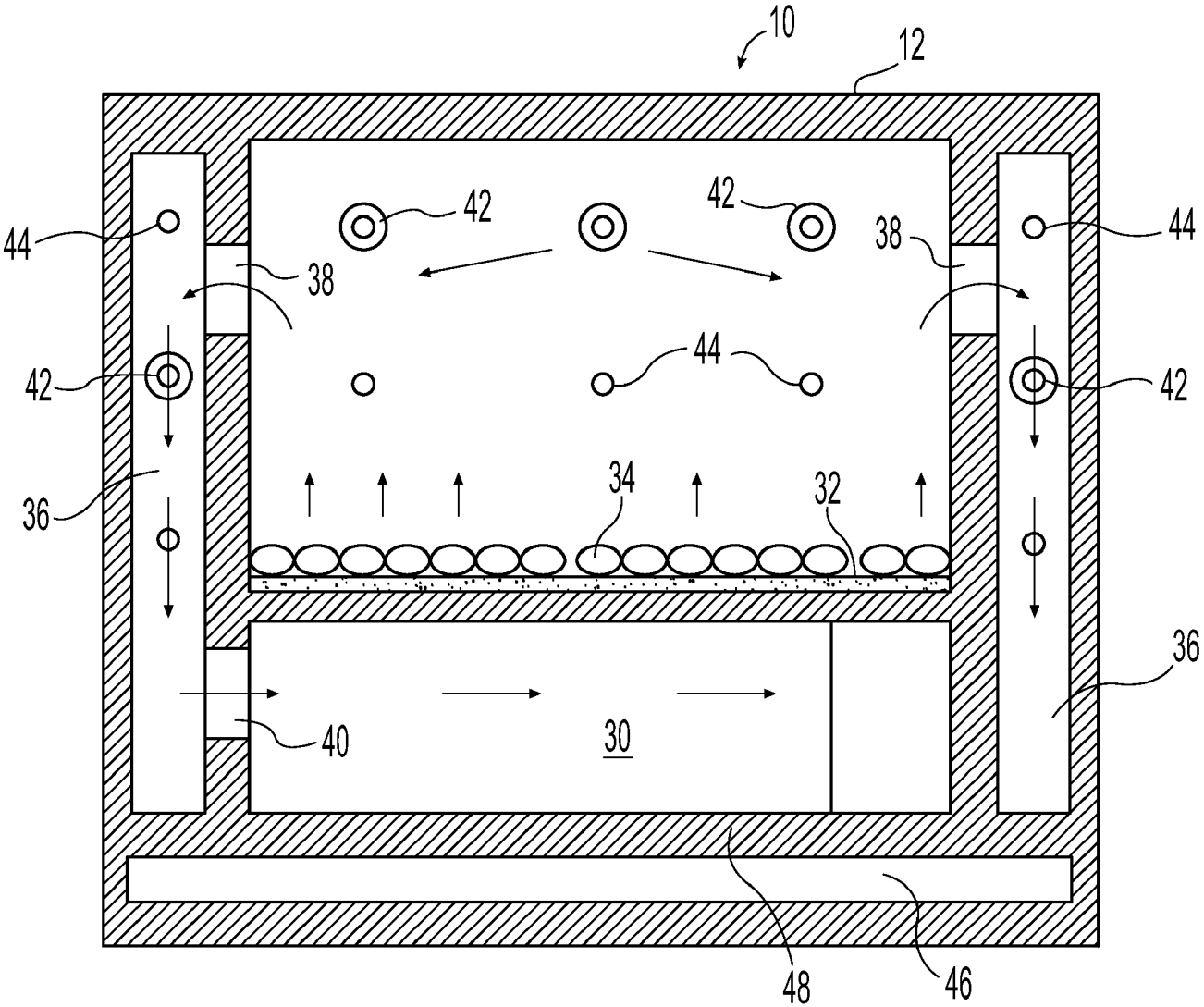
FIG. 5 is a cross-sectional view taken along line 5-5 of FIG. 2.
Figure 6:
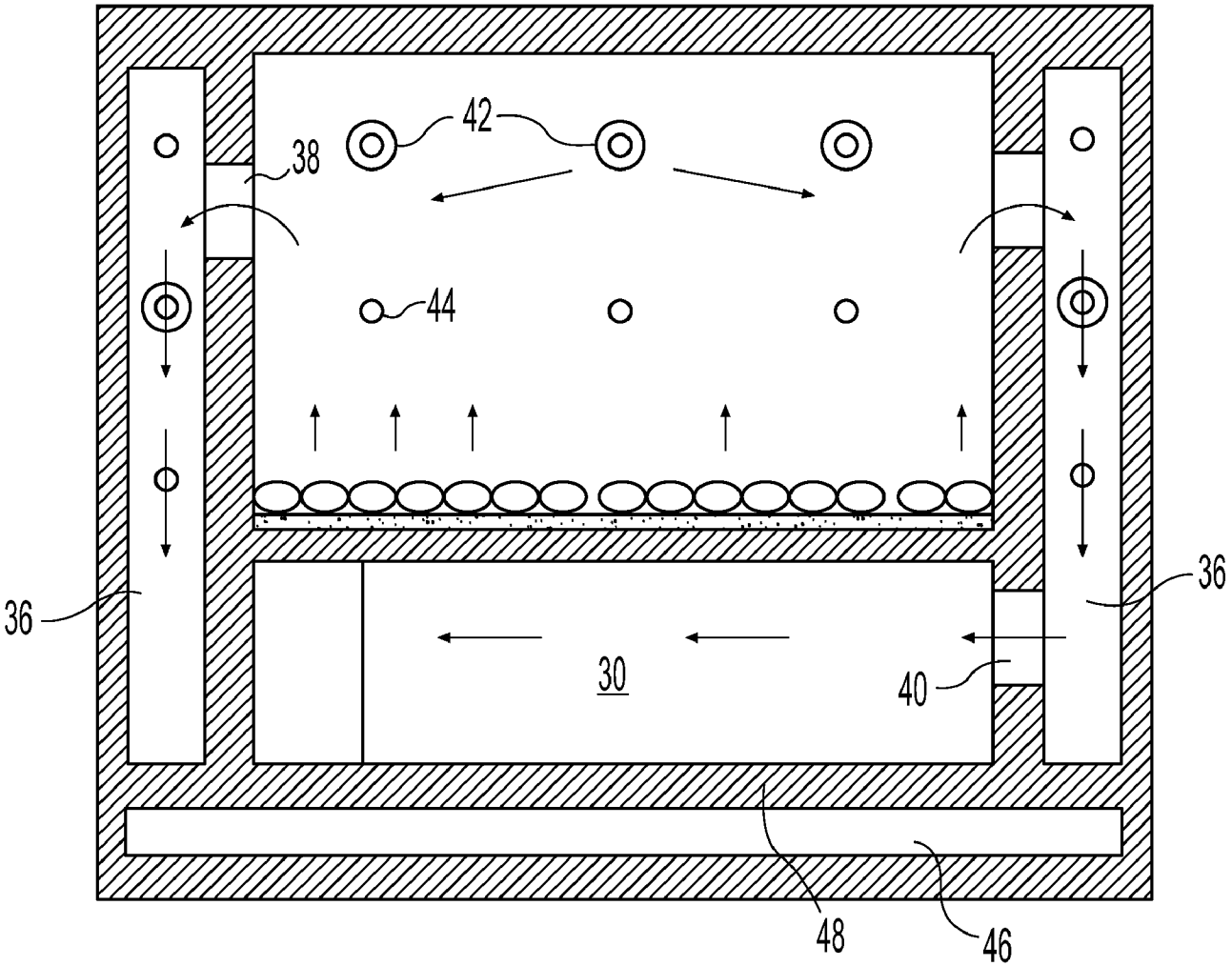
FIG. 6 is a cross-sectional view taken along line 6-6 of FIG. 2.

The burners 42 for heating of the reducible material in the hearth furnace 10 may be oxy-fuel burners 42. The oxy-fuel burners 42 are positioned to combust volatilized materials in the furnace and provide efficient combustion of the volatilized materials to efficiently reduce the reducible material to metallic iron material. The oxy-fuel burners 42 may be positioned such that there is at least one burner on each end of the furnace housing 12 above the stationary hearth 14. The burners 42 may be about a foot (about 0.3 meters) down from the roof of the furnace housing 12 as shown in FIG. 4. Alternately or in addition, the burners 42 may be provided in the heating chamber 28 as shown in FIGS. 3 and 4. Alternatively, or in addition, the burners 42 may be positioned in the passageways 36, as shown in FIGS. 4-6. In addition, oxygen lances (not shown) may be directed into the furnace housing 12 or other locations to enable a desired amount of combustion to generate heat and provide efficient conversion of the reducible material in the furnace.

Reducible material 34 is positioned on the stationary hearth 14 typically in the form of a mixture of finely divided iron ore, or other iron oxide bearing material, with a carbonaceous material, such as coke, char, anthracite coal or non-caking bituminous and sub-bituminous coal. The reducible material 34 may be mixtures of finely divided iron oxide-bearing material and carbonaceous material formed into agglomerates. The agglomerates of reducible material 34 may be pre-formed briquettes, balls, or extrusions, so that the mixtures of reducible material are presented to the hearth furnace 10 in discrete portions. Alternately, the agglomerates may be formed in situ on the stationary hearth as compacts or mounds. A layer of finely divided hearth material 32, which may be a carbonaceous material such as coke, char or coal, optionally may be provided on the stationary hearth 14, with the reducible material 34 positioned on the hearth material 32. The hearth material 32 avoids damage to the refractory materials of the hearth caused by related slag generated upon reducing the metallic iron in the furnace. The hearth material 32 may be re-used in subsequent operation of the hearth furnace, though recycled hearth material may provide a lower amount of volatile material in the furnace for combustion and heating. In any event, the reducible material 34 may be on the stationary hearth in a substantially singular layer so that the metallic iron nodules formed from the reducible material are of appropriate size to be readily handled.

The reducible materials on the stationary hearth 14 are heated by the burners 42, causing the reducible materials 34 and possibly the hearth materials 32 to give off volatile materials and other fluids during heating. Fluidized volatile materials are subsequently burned by the burners 42 above the reducible material 34 on the stationary hearth in the furnace housing 12. The passageways 36 also circulate uncombusted volatile materials and other fluids through upper ports 38 from the furnace housing above the reducible material to lower ports 40 into the heating chamber beneath the stationary hearth 14. Optionally, burners 42 may be positioned in the passageways 36 and heating chamber 28 to combust fluidized volatile materials that flow into the passageways and provide additional heat to reduce the reducible material on the stationary hearth.

The inlet to the passageway 36, upper port 38, is located to provide for combustion of the fluidized volatile material in the furnace housing 12, and to efficiently move the combusted fluids and volatile materials from the furnace housing to the heating chamber 28. During a drying process, the passageways 36 may direct a flow of moisture-laden gases out of the furnace housing. The passageways 36 should be insulated or integrated into the furnace housing 12 to reduce the loss of heat and to provide efficient transfer of heat from one part of the hearth furnace 10 to another, and in turn increase the efficiency of the hearth furnace 10 in reducing reducible material positioned on the stationary hearth 14.

Figure 2:
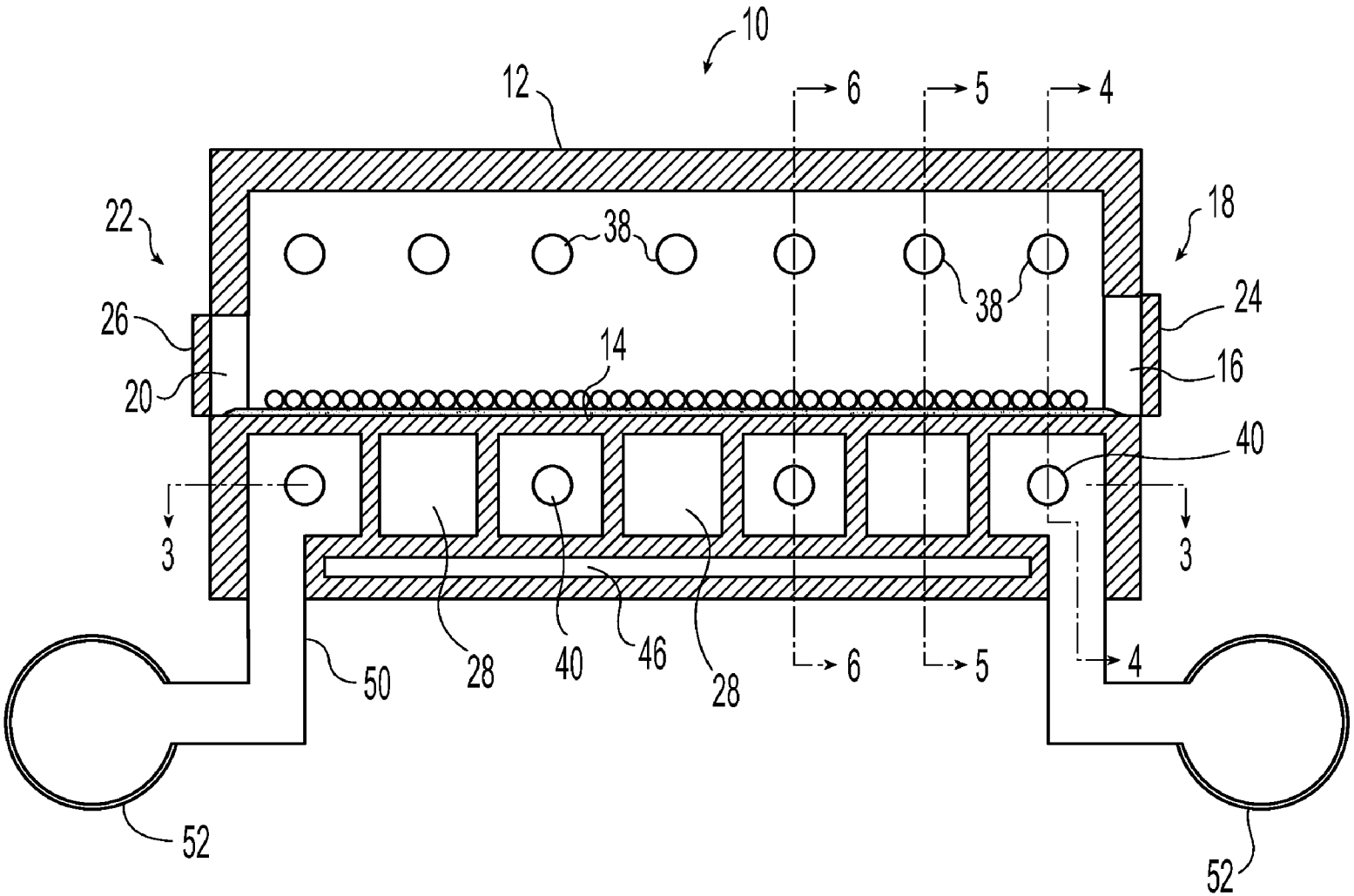
FIG. 2 is a longitudinal cross-sectional view taken through a stationary hearth furnace, illustrating an embodiment of one of the hearth furnaces shown in FIG. 1.

A flue 46 may be provided adjacent the heating chamber and capable of receiving and heating fluids and transferring heated fluids from the flue into the furnace housing 12. The flue 46 may be beneath the heating chamber 28, where the flue 46 is capable of receiving heat from the heating chamber. As shown in FIGS. 2 and 4, the flue 46 may be separated from the heating chamber 28 by a heat conductive partition or wall 48. Air and other fluids may be directed through the flue 46 to heat the air and other fluids before being directed into the furnace housing 12 through the ports 44, and may be directed into other locations, or directed for use in other processes. By preheating the air and other fluids in the flue, the pre-heated air enters the hearth furnace or other process at an elevated temperature for improved process efficiency in reducing reducible material positioned on the stationary hearth 14.

At least one gas exhaust port 50 connects the heating chamber 28 with a waste gas duct 52. As shown in FIG. 3, a gas exhaust port 50 may be positioned on one or both ends of the heating chamber. Alternately or in addition, a gas exhaust port 50 may be positioned in the center of the heating chamber (not shown). The gas exhaust ports 50 direct hot fluids from the heating chamber 28 to at least one waste gas duct 52. The fluid leaving the heating chamber 28 may be substantially free of volatile materials as the volatiles are consumed in the furnace housing 12 and the heating chamber 28.

The waste gas ducts 52 may be located adjacent the hearth furnace 10, and may be beneath the ground. When the stationary hearth furnaces 10 are arranged in a battery or group, the waste gas ducts 52 may be located such that the gas exhaust ports 50 of a plurality of stationary hearth furnaces 10 each connect to the same waste gas ducts 52. In this way, the waste gas may be efficiently directed to a gas cooling and reclamation system 54.

One or more baffles or barriers (not shown) may be provided within the furnace housing 12 to control fluid flow over the stationary hearth 14. If present, the baffles or barriers may be perforated, such as with a grate for example, or otherwise discontinuous to allow for efficient flow of fluidized volatile material. The baffles may be made of a suitable refractory material, such as silicon carbide.

The stationary hearth furnace 10 includes a controller 56, shown schematically in FIG. 4, capable of monitoring and controlling the flow of fluids through the hearth furnace 10, and regulating temperatures of the reducible material on the stationary hearth 14. The controller may regulate temperatures of the fluids above and below the stationary hearth 14, the composition of the atmosphere, volume of fluid flow, fuel flow to the burners, and other attributes to control and maintain the desired processes within the hearth furnace 10. As temperatures within the furnace are higher or lower then a desired processing temperature, the controller may adjust the flow of fuel to the burners to maintain the desired processing temperature in the reducible material positioned on the stationary hearth 14.

Figure 7:
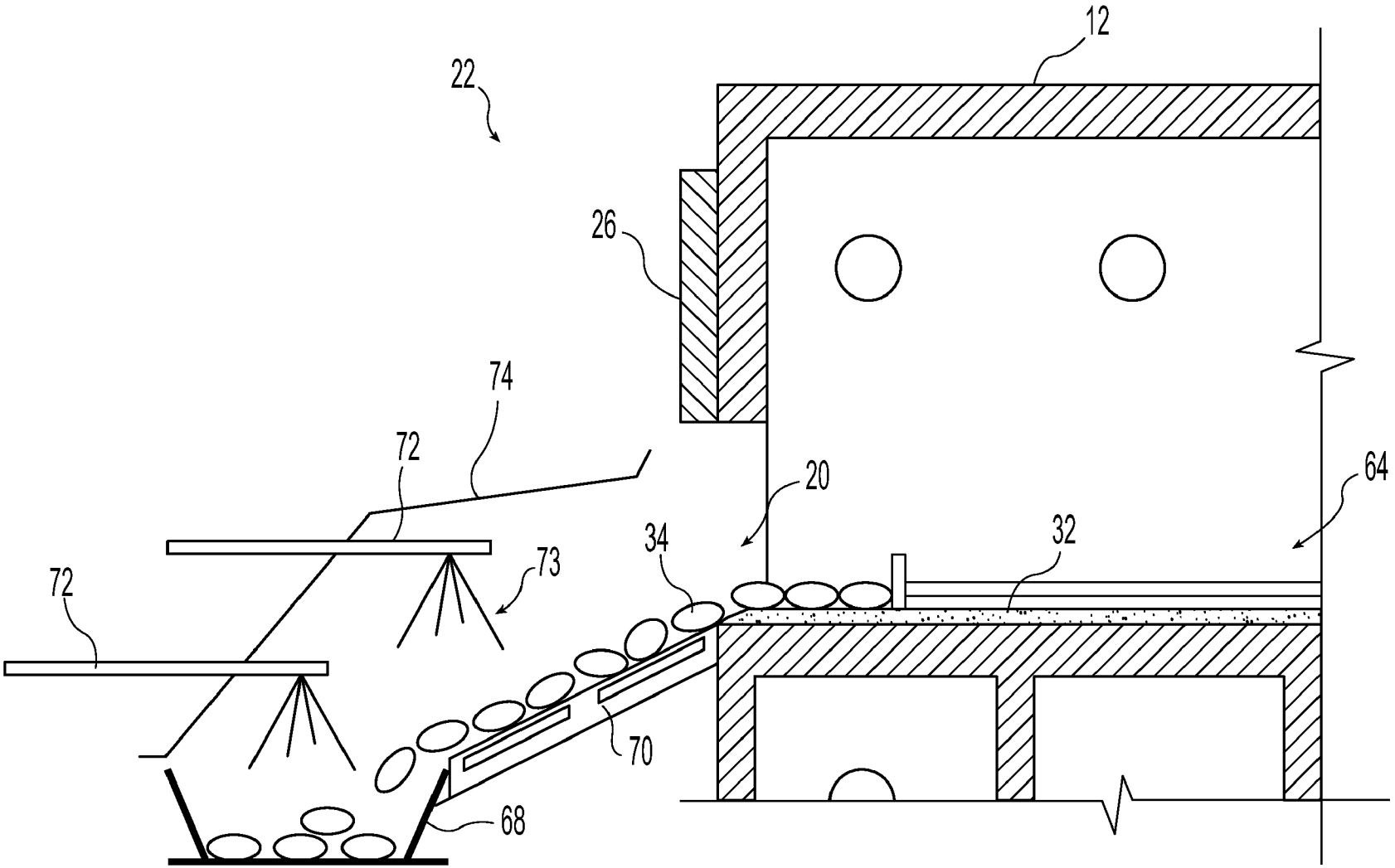
FIG. 7 is a partial sectional view of FIG. 2 showing a pusher mechanism for unloading the stationary hearth furnace and cooling the removed metallic iron nodules.
Figure 9:
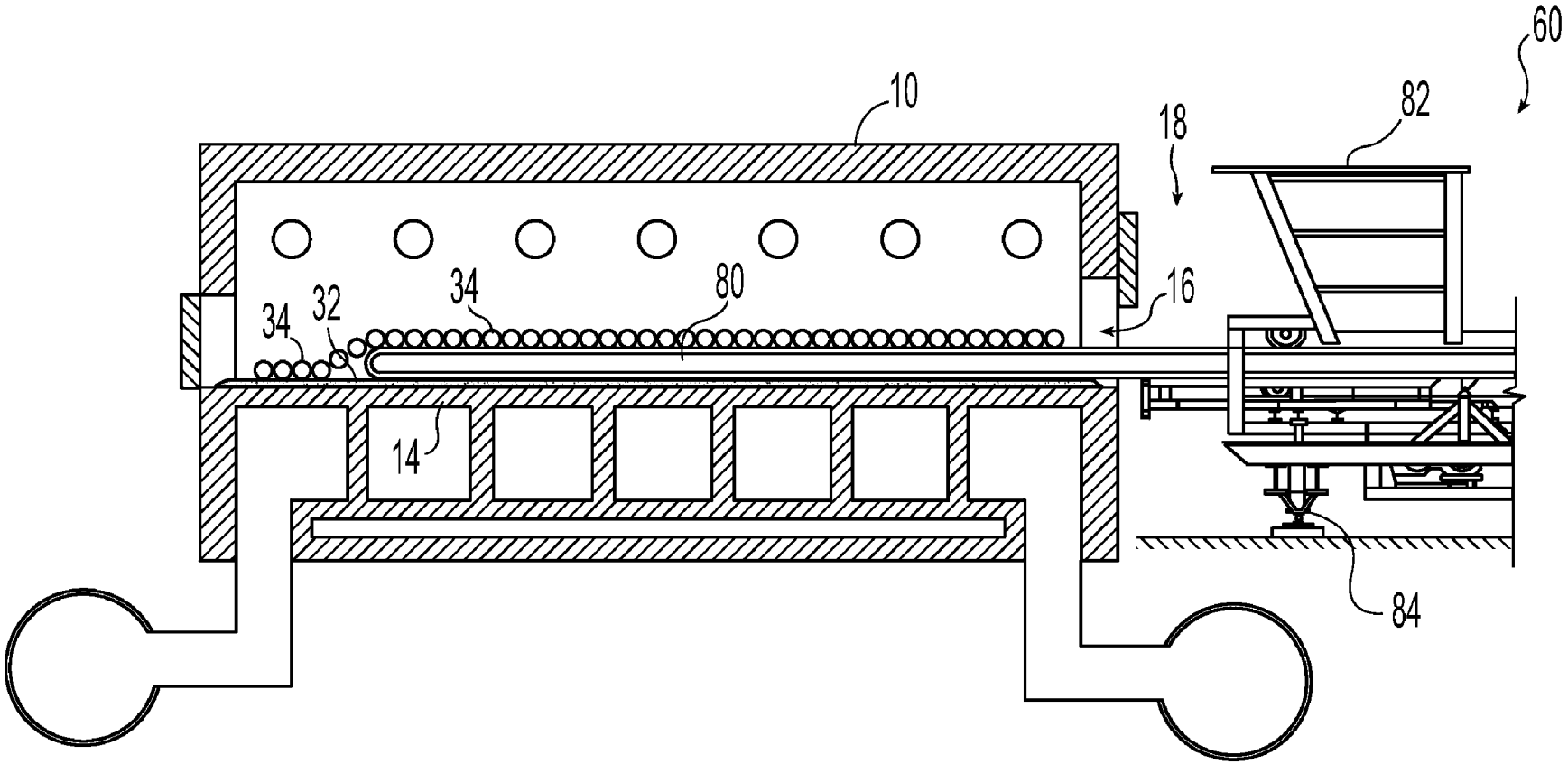
FIG. 9 is the sectional view of FIG. 2 showing a retractable loading conveyor for loading materials into the stationary hearth furnace.

As shown in FIG. 9, a loading device 60 is provided, capable of loading reducible material 34 and optionally hearth material 32 onto the stationary hearth 14 through the inlet 16 in the first side 18 of the furnace housing 12, and as shown in FIG. 7, a discharging device 64 is provided capable of discharging metallic iron nodules and optionally related material from the stationary hearth 14 through the outlet 20 in the second side 22 of the furnace housing 12. The inlet door 24 is opened to facilitate entry of the loading device 60 into the furnace housing 12, and both the inlet door 24 and the outlet door 26 may be opened to facilitate the discharge device 64. In any event, the inlet door 24 and the outlet door 26 should be opened only as necessary to avoid heat loss from the stationary hearth furnace.

After the metallic iron nodules and optionally related material are discharged from the stationary hearth 14 through the outlet 20, the removed materials are conveyed away from the hearth furnace by conveyor 68. As shown in FIGS. 7 and 8, the conveyor 68, optionally with an apron, is positioned to receive discharged materials from one or more stationary hearth furnaces. One conveyor 68 may be used for a battery of six, seven, or more stationary hearth furnaces. Multiple conveyors 68 may be used to transfer discharged materials from a plurality of batteries of stationary hearth furnaces to a collection and processing area 76. More than one conveyor 68 may feed one or more collection conveyors 78, which may transport the discharged material to the collection and processing area 76 for separation and further cooling. In the processing area 76, the metallic iron nodules may be separated from the carbonaceous materials and slag materials. The carbonaceous materials may be recycled in subsequent hearth furnace processes as desired.

As shown in FIGS. 7 and 8, the second side 22 of the furnace includes a slide chute 70. The slide chute 70 may include an internally cooled plate or other cooling device to maintain the slide chute at a desired temperature. At the discharge, one or more nozzles 72 are capable of providing a cooling spray 73, such as water mist, air, nitrogen or other gas flow, combination of water and gas flow, or other cooling medium, over the metallic iron nodules and other related materials. The cooling spray 73 reduces the temperature of the metallic iron material from its formation temperature in the hearth furnace to a temperature at which the metallic iron material can be reasonably handled and further processed. This handling temperature is generally about 1400 to 1650° F. (about 760 to 900° C.) and below. A hood 74 may be provided over the discharging materials at the chute 70 and the conveyor 68 to capture dust, water vapor, gases and other particulate and gas emissions from the discharging materials. The hood 74 may be vented to a baghouse filter or other filter or reclamation device (not shown).

As shown in FIG. 9, the loading device 60 may comprise a retractable conveyor 80. At least one hopper 82 may be provided on the loading device 60, capable of placing desired materials on the conveyor 80 as the conveyor extends into the stationary hearth furnace. As the conveyor belt advances placing the materials on the stationary hearth, the conveyor 80 retracts from the furnace housing 12. The belt speed and retraction speed may be varied as desired to provide a predetermined amount of material on the stationary hearth. In this way, the conveyor 80 may be used to optionally place the hearth material 32 on the stationary hearth feeding from a first hopper 82, and then used to place the reducible material 34 over the hearth material 32 from a second hopper 82 (not shown). Two hoppers 82 and two extensions and retractions of the conveyor 80 may be used to position the hearth material and then the reducible material on the stationary hearth 14.

The loading device 60 may be movable on a guide 84, capable of moving the loading device from one stationary hearth furnace in the battery to another. The guide 84 may be one or more rails extending along the battery of hearth furnaces, in cooperation with wheels, slides, trundle, carriage, or another movable support capable of moving the loading device from one hearth furnace in the battery to another. In this way, one loading device may be used to sequentially load all stationary hearth furnaces in a battery. The operation of the battery of furnaces may be varied such that as soon as the material in one stationary hearth furnace is discharged, the loading device is positioned and ready to re-load the empty furnace. While the loading device loads one stationary hearth furnace, another furnace in the battery may be prepared to unload to coincide with the availability of the loading device 60 and processing of the reducible material to form metallic iron nodules in the other stationary hearth furnaces in the battery performed independently through the various stages of converting the reducible material to metallic iron nodules as described herein.

Figure 10:
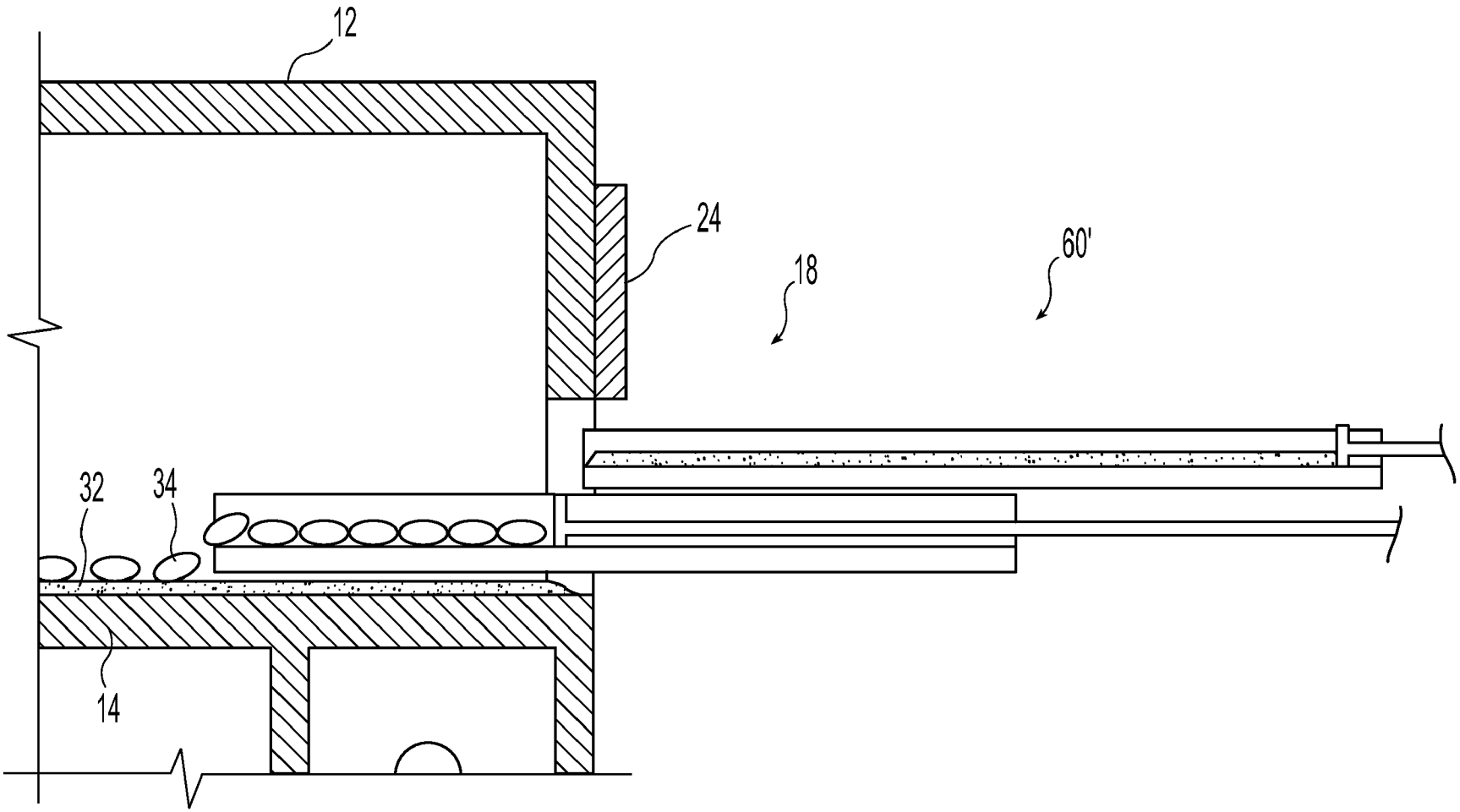
FIG. 10 is the sectional view of FIG. 2 showing a retractable tray with pusher for loading materials into the stationary hearth furnace.

In one alternate, the hearth furnace is loaded by positioning a loading device 60' having a movable device over the stationary hearth with the reducible material and optionally the underlying hearth material. The movable device may then be removed from the furnace housing leaving reducible material, and if present, the underlying hearth material on the stationary hearth, such as shown in FIG. 10, before varying the temperature within the furnace housing to dry and heat the reducible material, driving off and burning volatile material from the reducible material, and reducing at least a portion of the reducible material to form metallic iron nodules. Alternately, the movable device may be made of a material, such as a refractory material, capable of remaining in the furnace housing during the heating of the reducible material and forming of metallic iron nodules, and the metallic iron nodules and other materials may be discharged by removing the movable device from the furnace housing.

The stationary hearth furnace 10 may be a facility to practice a method of producing metallic iron nodules in a battery of stationary hearth furnaces including steps of assembling a furnace housing having a stationary hearth, an inlet capable of delivering reducible material to the stationary hearth from a first side, and an outlet capable of discharging reduced iron nodules from the stationary hearth from a second side opposite the first side, a heating chamber beneath the stationary hearth capable of having heated fluids circulated thereto and heating the reducible material on the stationary hearth, passageways capable of circulating fluids given off by heating the reducible material positioned on the stationary hearth through ports from the furnace housing above the reducible material to the heating chamber beneath the stationary hearth, and burners and fluid inlet ports in the furnace housing and optionally in the passageways and heating chamber to heat the reducible material on the stationary hearth. Then, loading reducible material and optionally hearth material onto the stationary hearth through the inlet in the first side of the furnace housing, and varying the temperature within the furnace housing to dry and heat the reducible material, drive off and burning volatile material from the reducible material, and reduce at least a major portion of the reducible material to form metallic iron nodules. Then, discharging the metallic iron nodules and optionally related material from the stationary hearth furnace through the outlet in the second side of the furnace housing.

The step of varying the temperature within the furnace housing to dry and heat the reducible material, drive off and burn volatile material from the reducible material, and reduce at least a portion of the reducible material includes processing steps within the hearth furnace 10. Optionally, a drying/preheating step may be provided by heating to a desired temperature for a pre-determined drying time to remove moisture from the reducible materials on the stationary hearth. Then, a conversion step is provided by heating the reducible materials to a higher temperature for a pre-determined duration to drive off remaining moisture and at least a portion of the volatiles in the reducible material. Then, a fusion step is provided by further heating the reducible materials to a temperature capable of fusing and forming the metallic iron material.

In the drying/preheat step, moisture is driven from the reducible material and the reducible material is heated to a temperature up to or less than the temperature generally associated with fluidizing most of the volatiles in and associated with the reducible material positioned on the stationary hearth 14. Stated another way, the reducible materials may reach a temperature in the drying/preheat atmosphere just lower than the temperature causing significant volatilization of carbonaceous material in and associated with the reducible material. This temperature is in the range of about 150 to 315° C. (about 300 to 600° F.), depending in part on the particular composition of the reducible material. Significant fluidization of volatile materials should not take place in the drying/pre-heating step. The burners may be fueled by natural gas, propane, or other fuels.

The conversion step is characterized by heating the reducible material to drive off most of the volatiles in the reducible material (together with remaining moisture) and then to initiate the reduction process in forming the reducible material into metallic iron material and slag. The conversion step is generally characterized by heating the reducible material to about 815 to 1150° C. (about 1500 to 2100° F.), depending on the particular composition and form of reducible material. The volatile materials are burned by the burners 42, increasing the temperature of the furnace and reducing the need for other fuels to feed the burner. However, some coals have a lower content of volatile material. When the amount of volatile materials is not sufficient to maintain the desired process temperature, the controller may feed additional natural gas, propane, or other fuel to the burner to combust and in turn heat the reducible material.

The fusion step involves further heating the reducible material, now absent of most volatile materials, to commence to form metallic iron, fusing the metallic iron in nodules, with separated slag. The fusion zone generally involves heating the reducible material to about 1315 to 1370° C. (about 2400 to 2550° F.), or higher, to provide highly efficient fusion of metallic iron nodules with a low percentage of iron oxide in the metallic iron. If the process is carried out efficiently, there will also be a low percentage of iron oxide in the slag, since the process is designed to reduce a very high percentage of the iron oxide in the reducible material to metallic iron.

Optionally, a cooling step may be included by providing, for example, a nitrogen purge to lower the temperature of the metallic iron nodules and other materials that are on the stationary hearth 14.

In addition, the method may further comprise placing an overlayer of coarse carbonaceous material as described in U.S. Patent Application Ser. No. 60/820,366, filed Jul. 26, 2006. This may be accomplished with loading device 60 by providing a third hopper 82 and extension and retraction of conveyor 80 in the stationary hearth furnace for a second or third time, depending on whether an underlying hearth material is also provided While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A battery of stationary hearth furnaces operable to produce metallic iron nodules comprising:

a plurality of stationary hearth furnaces, each stationary hearth furnace including:

a furnace housing having a stationary hearth, an inlet on a first side operable to deliver reducible material to the stationary hearth, and an outlet on a second side opposite the first side operable to discharge reduced iron nodules from the stationary hearth;

a heating chamber beneath the stationary hearth operable to circulate heated fluids heating reducible material on the stationary hearth;

passageways between ports in the furnace housing and the heating chamber operable to circulate fluids given off by heating reducible material on the stationary hearth through the ports from the furnace housing above the reducible material to the heating chamber beneath the stationary hearth;

burners and air inlet ports in the furnace housing above the stationary hearth and optionally in the passageways and heating chamber capable of drying and heating the reducible material, driving off and burning volatile material from the reducible material, and reducing at least a major portion of the reducible material to form metallic iron nodules;

a loading device movable from one stationary hearth furnace in the battery to another operable to load reducible material and optionally an underlying hearth material onto the stationary hearths of the plurality of stationary hearth furnaces through the inlet in the first side of each furnace housing; and a discharging device operable to discharge metallic iron nodules and optionally related material from the stationary hearth through the outlet of the second side of the furnace housing.

2. The battery of stationary hearth furnaces as claimed in claim 1, the movable loading device positioning the reducible material and optionally the hearth material onto the stationary hearth.

3. The battery of stationary hearth furnaces as claimed in claim 1, the movable loading device loading the reducible material onto the stationary hearth in a substantially singular layer.

4. The battery of stationary hearth furnaces as claimed in claim 1, the movable loading device being loaded with the reducible material and optionally the hearth material, and then being positioned on the stationary hearth.

5. The battery of stationary hearth furnaces as claimed in claim 4 where the movable loading device is removable from the furnace housing leaving the reducible material and if present the underlying hearth material on the stationary hearth.

6. The battery of stationary hearth furnaces as claimed in claim 1, the discharging device pushing at least a majority of the reduced metallic nodules from the stationary hearth through the outlet in the second side in the furnace housing.

7. The battery of stationary hearth furnaces as claimed in claim 1 where the heating chamber has baffles increasing the residence time of the heated fluids in the heating chamber and heating the reducible material on the stationary hearth in the furnace housing.

8. The battery of stationary hearth furnaces as claimed in claim 1 further comprising a flue adjacent the heating chamber and capable of receiving and heating fluids and transferring heated fluids from the flue into the furnace housing.

9. The battery of stationary hearth furnaces as claimed in claim 1, further comprising a controller operably controlling flow of fuel to the burners heating the reducible material in the heating chamber to a first temperature, and then heating the reducible material in the heating chamber to a second temperature.

* * * * *